US005713220A

United States Patent [19]

Seino et al.

[11] Patent Number: 5,713,220

[45] Date of Patent: Feb. 3, 1998

[54] PILE PATTERNING MECHANISM FOR CIRCULAR KNITTING MACHINE AND KNITTED ARTICLE KNITTED BY THE CIRCULAR KNITTING MACHINE

[75] Inventors: Masahiro Seino; Hiromasa Hirose; Satoshi Okoshi, all of Bunsui-Machi; Shinya Yamamoto, Ibaraki, all of Japan

[73] Assignee: Nagata Seiki Kabushiki Kaisha, Tokyo-to, Japan

[21] Appl. No.: 681,845

[22] Filed: Jul. 29, 1996

[30] Foreign Application Priority Data

Jul. 31, 1995 [JP] Japan ..... 7-194843
Jul. 31, 1995 [JP] Japan ..... 7-195220

[51] Int. Cl.[6] ..... D04B 9/00

[52] U.S. Cl. ..... 66/106; 66/9 R; 66/31

[58] Field of Search ..... 66/9 R, 13, 36, 66/106, 110

[56] References Cited

U.S. PATENT DOCUMENTS

| | | | |
|---|---|---|---|
| 681,451 | 8/1901 | Hirner | 66/106 |
| 1,255,258 | 2/1918 | Wilcomb | 66/106 X |
| 3,512,377 | 5/1970 | Widdowson et al. | 66/36 |
| 4,693,092 | 9/1987 | Plath | 66/106 X |
| 4,741,181 | 5/1988 | Plath | 66/106 X |
| 4,751,829 | 6/1988 | Plath | 66/106 X |
| 5,001,909 | 3/1991 | Tibbals et al. | 66/9 R |

FOREIGN PATENT DOCUMENTS

| | | | |
|---|---|---|---|
| 0629727 | 12/1994 | European Pat. Off. . | |
| 2460868 | 7/1976 | Germany | 66/106 |
| 3059182 | 2/1991 | Japan . | |
| 3-36550 | 3/1991 | Japan . | |
| 7229037 | 8/1995 | Japan . | |

*Primary Examiner*—John J. Calvert
*Attorney, Agent, or Firm*—Ladas & Parry

[57] ABSTRACT

A pile patterning mechanism for a circular knitting machine comprises: a sinker bed provided with a plurality of radial, horizontal grooves and disposed on the outer circumference of an upper end of a needle cylinder; a plurality of pile sinkers fitted in the radial, horizontal grooves of the sinker bed so as to be slidable and tiltable. A plurality of horizontal pile jacks each having a plurality of butts are fitted in the radial, horizontal grooves of the sinker bed on the radially outer side of the pile sinkers so as to be slidable and tiltable; and a control unit is provided for controlling the pile sinkers and the pile jacks to slide and tilt the pile jacks and the pile sinkers. The control unit includes a plurality of sinker cams, a jack selecting device provided with a plurality of actuators, and jack cams. The horizontal arrangement of the pile jacks ebables the pile jacks to exert a reliable action on the pile sinker. A knitted article has at least a pile stitch portion of an optional pattern formed by the reciprocating turning operation of a needle cylinder. Pile loops can be formed on optional wales by the reciprocating turning operation of the needle cylinder regardless of the needle loop forming operations of the needles.

20 Claims, 19 Drawing Sheets

O - A

O - B

O - E

O - M

PILE PATTERNING MECHANISM FOR CIRCULAR KNITTING MACHINE AND KNITTED ARTICLE KNITTED BY THE CIRCULAR KNITTING MACHINE

BACKGROUND OF THE INVENTION

1. Field of the Invention

The present invention relates to a pile patterning mechanism for a circular knitting machine for knitting socks, stockings or the like, and knitted articles knitted by the same circular knitting machine.

2. Description of the Related Art

A pile patterning mechanism for use in combination with a circular knitting machine of this kind is disclosed, for example, in JP-B No. 3-59182. This prior art pile patterning mechanism comprises a sinker bed provided with a plurality of radial, horizontal grooves and disposed over the outer periphery of a needle cylinder, pile sinkers and selector jacks slidably fitted in pairs in the horizontal grooves of the sinker bed, and a selector jack selecting device capable of selectively operating on a plurality of butts formed on a vertically extending rear portion of each of the selector jacks.

This prior art pile patterning mechanism is capable of patterning at a high speed and forming patterns by fine stitches. However, upper and lower portions of the vertical rear portion of the selector jack are bent when the selector jack is selected, because the selector jack selecting device selects the selector jack by pressing one of the plurality of butts of the vertical rear portion of the selector jack to operate the pile sinker operated by the selector jack. Consequently, the selector jack operates the selector jack unstably, whereby the pattern is broken and a defective knitted article is produced.

A pile patterning mechanism for a circular knitting machine was developed to solve such a problem and proposed in JP-A No. 7-229037 published on Aug. 29, 1995. This previously proposed pile patterning mechanism comprises: a sinker bed provided with a plurality of radial, horizontal grooves and a plurality of vertical grooves respectively connected to the horizontal grooves, and disposed over the outer periphery of a needle cylinder; pile sinkers slidably fitted in the horizontal grooves of the sinker bed and each provided at its radially inner end with a large nib and a small nib; selector jacks slidably fitted in the vertical grooves of the sinker bed and each provided with a plurality of butts; a selector jack selecting device for operating selected selector jacks; a jack cam that engages with the selected jacks to hold the pile sinkers at a high position; and a cam device for radially sliding the pile sinkers slidably fitted in the horizontal grooves of the sinker bed between the high position and a low position.

In this previously proposed pile patterning mechanism, the selector jack has a relatively short horizontal arm portion as compared with a vertically extending principal portion thereof, due to restrictions imposed thereon by a space available for installing the selector jack. Therefore, the horizontal arm portion of the selector jack moves only slightly when the vertically extending principal portion of the selector jack is moved to select the selector jack. Consequently, the selector jack is unable to exert a satisfactory action on the rear end of the pile sinker, whereby an irregular pile pattern tends to be formed and a defective knitted article is produced.

Furthermore, in the previously proposed pile patterning mechanism, the sinker bed necessarily has a large vertical thickness since the sinker bed accmmodates the vertically extending principal portions of the selector jacks therein. The large vertical thickness of the sinker bed occupies a considerable large annular space around the needle cylinder. As is well known, the space around the needle cylinder must be used to install a number of cams for controlling the needles, the down- and up-pickers for enabling knitting of heel and toe portions of socks, stockings, and so on. However, in the previously proposed pile patterning mechanism, the space around the needle cylinder could not be utilized fully because of the large vertical thickness of the sinker bed, and it was necessary to carry out the loop decreasing and increasing operation by using the selecting function of the cylinder jacks.

Referring to FIG. 30 showing one of a pair of socks 21 knitted by a conventional circular knitting machine, the sock 21 has a rib top section 22, a body section 23, a heel section 24, an insole section 25, a sole section 26 and a toe section 27. A needle cylinder is turned in the normal direction to knit the rib top section 22 and the body section 23, and the needle cylinder is turned alternately in the normal direction and in the reverse direction to knit the heel section 24 and the toe section 27. The heel section 24 and the toe section 27 are provided with pile stitch portions, respectively, to provide the heel section 24 and the toe section 27 with an enhanced cushioning property.

Since the needle cylinder is turned alternately in the normal direction and the reverse direction to form the pile stitch portions in the heel section 24 and the toe section 27, piles are formed on all the wales of loops formed by the needles in the heel section 24 and the toe section 27.

A pile stitch article (a pair of socks) disclosed in, for example, JP-U No. 3-36550 is formed by plain-knitting a ground yarn and a pile yarn, and has a pile stitch portion formed by enlarging sinker loops, and a pile stitch portion formed by further enlarging sinker loops by pile jacks.

There are socks knitted by a circular knitting machine, and having piles formed on all the courses of a heel section and a toe section by turning a needle cylinder alternately in the normal direction and the reverse direction. In knitting these socks, the circular knitting machine is unable to form an optional pile pattern by forming jack pile loops or sinker pile loops on optional wales during the reciprocating operation of the needle cylinder regardless of needle loop forming operations of needles, and unable to form different pile loops on optional wales during the turning of the needle cylinder in the normal direction and in the reverse direction. Thus, the circular knitting machine is able to knit socks having limited patterns and limited functions.

SUMMARY OF THE INVENTION

The present invention has been made in view of the foregoing problem and it is therefore an object of the present invention to provide a pile patterning mechanism for a circular knitting machine, employing pile jacks reliably held for stable operation in horizontal grooves for pile sinkers, and capable of forming a sharp pile pattern.

It is a further object of the present invention to provide a pile patterning mechanism wherein the space around the needle cylinder can be utilized fully so that the necessary cams, down- and up-pickers and so on can be installed around the needle cylidner without design restrictions.

Another object of the present invention is to provide a knitted article knitted by a circular machine provided with the aforesaid pile patterning mechanism.

The present invention provides a pile patterning mechanism for a circular knitting machine, comprising: a sinker bed provided with a plurality of radial, horizontal grooves and disposed on an outer circumference of an upper end of a needle cylinder; a plurality of pile sinkers fitted in the radial, horizontal grooves of the sinker bed, respectively, so as to be slidable along, and tiltable in the grooves; and a pile sinker control means for controlling the pile sinkers to slide and tilt the same; a plurality of pile jacks each having a plurality of butts and an end for acting on said pile sinkers; and a pile jack control means for controlling the pile jacks, the pile jack control means including a jack selecting device: characterised in that the pile jacks are fitted and extend in said radial, horizontal grooves of the sinker bed on a radially outer side of the pile sinkers so as to be slidable along, and tiltable in the grooves, and the pile jack control means includes cam means for acting on the pile jacks.

The present invention also provides a knitted article having at least a pile stitch portion of an optional pattern formed by the reciprocating turning operation of a needle cylinder, wherein pile loops are formed on optional wales by the reciprocating turning operation of the needle cylinder regardless of needle loop forming operations of needles.

Thus, the present invention provides knitted articles having a large variety of patterns and an increased commercial value.

Preferred embodiments of the present invention will be understood from the following detailed description referring to the accompanying drawings.

BRIEF DESCRIPTION OF THE DRAWINGS

FIG. 5(*b*) is a perspective view of a pile yarn guide and a base yarn guide;

DESCRIPTION OF THE PREFERRED EMBODIMENTS

Figure 1:
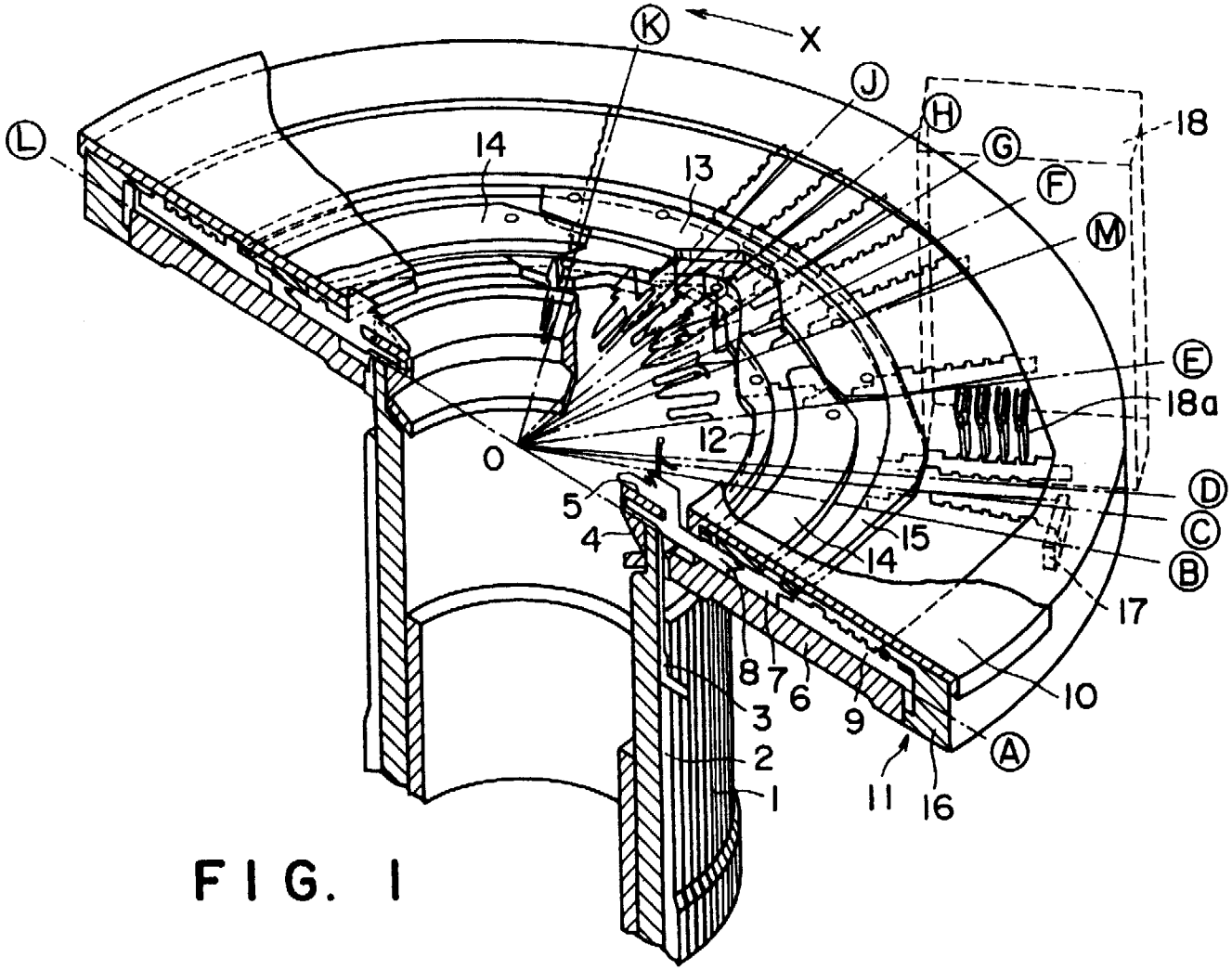
FIG. 1 is a half sectional perspective view of a pile patterning mechanism in a preferred embodiment according to the present invention.
Figure 2:
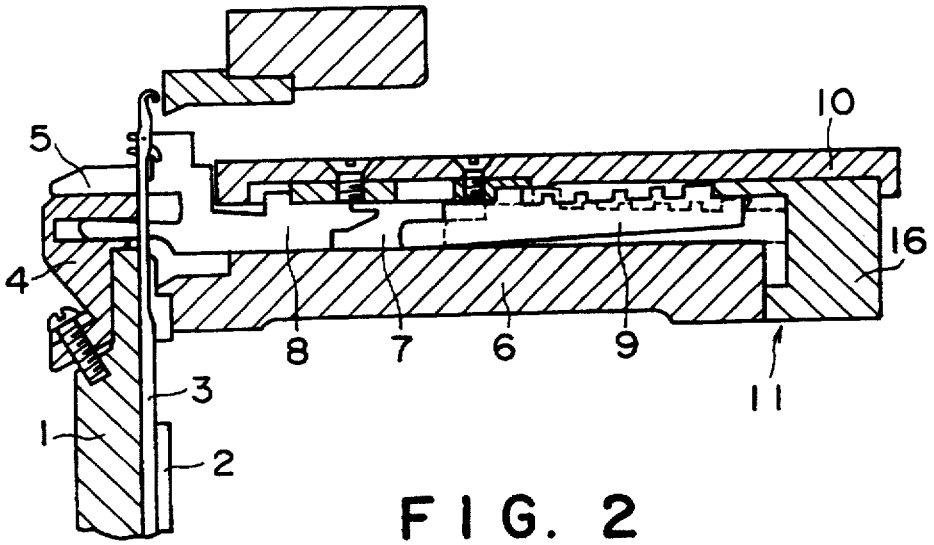
FIG. 2 is a fragmentary sectional view of the pile patterning mechanism of FIG. 1.

Referring to FIGS. 1 and 2, a needle cylinder 1 is supported for rotation on a bed, not shown, vertical grooves 2 are formed at equal angular intervals in the outer circumference of the needle cylinder, and needles 3 are fitted vertically slidably in the vertical grooves 2. A top cylinder 4 provided with a plurality of horizontal, radial grooves 5 is fitted in the upper end of the needle cylinder 1. A disk-shaped sinker bed 6 is put on the outer circumference of the upper end of the needle cylinder 1. The sinker bed 6, similarly to the top cylinder 4, is provided in its upper surface with a plurality of radial horizontal grooves 7. A pile sinker 8 and a pile jack 9 are radially slidably fitted in each horizontal groove 7. The pile sinker 8 is on the radially inner side of the pile jack 9. Radially inner end portions of the pile sinkers 8 fitted in the horizontal grooves 7 are guided by the horizontal grooves 5 of the top cylinder 4, respectively.

Figure 3:
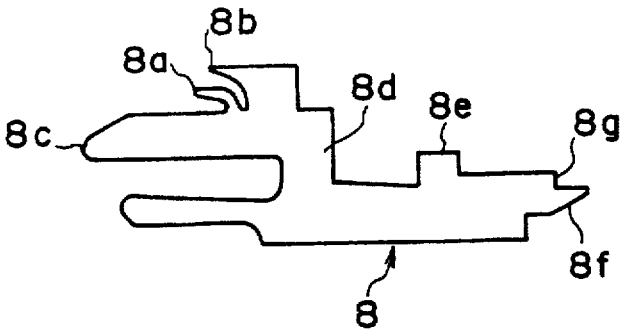
FIG. 3 is a side view of a pile sinker.

As shown in FIG. 3, each pile sinker 8 has a small nib 8*a*, a large nib 8*b* extending above the small nib 8*a* and a guide nose 8*c* extending under the small nib 8*a* and project-ing radially inward beyond the tip of the small nib 8*a* in its radially inner end portion, a back edge 8*d* in its middle portion, and an upwardly projecting butt 8*e* positioned radially outward of the back edge 8*d*, a tail nib 8*f* having an inclined lower edge, and a cam following part 8*g* in its radially outer end portion. The pile jack 9 acts on the inclined lower edge of the tail nib 8*f* to thrust up the pile sinker 8. The back edge 8*d* extends downward from the rear end of the guide nose 8*c*.

Figure 4:
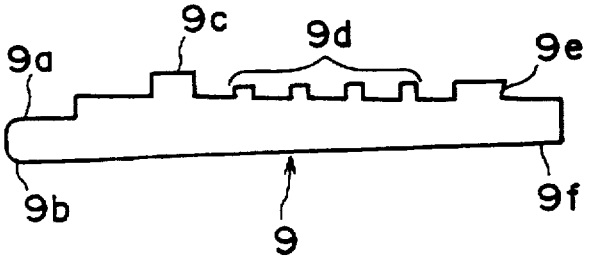
FIG. 4 is a side view of a pile jack.

As shown in FIG. 4, each pile jack 9 has a thrusting nose 9*a*, a pivotal part 9*b*, an upwardly projecting main butt 9*c*, a plurality of upwardly projecting pattern butts 9*d* (four pattern butts in this embodiment), a cam butt 9*e* and a rear end part 9*f* arranged in that order from the front to the rear end thereof. The thrusting part 9*a* acts on the tail nib 8*f* of the pile sinker 8 to thrust up the pile sinker 8. The cam butt 9*e* of the pile jack 9 is in engagement with a jack cam 16, which will be described later, and the rear end part 9*f* of the pile jack 9 is in engagement with a push-up cam 17, which will be described later.

As shown in FIG. 1, a disk-shaped sinker cap 10 is disposed over the disk-shaped sinker bed 6 so as to cover the sinker bed 6. The disk-shaped sinker cap 10 is provided in its lower surface with a cam mechanism 11 and is fixed to a main frame, not shown, of a knitting machine. The cam mechanism 11 has a substantially annular center cam 12, a counter center cam 13, an outer guide cam 14, an annular leveling cam 15 and the annular jack cam 16. The center cam has a radially outwardly convex cam section and acts on the radially inner edge of the butts 8e of the pile sinkers 8. The counter center cam 13 is formed on the radially outer side of the center cam 12 and acts on the radially outer edges of the butts 8e of the pile sinkers 8. The outer guide cam 14 is continuous with the counter center cam 13. The annular leveling cam 15 has a radially outwardly convex cam section, is disposed on the radially outer side of the counter center cam 13 and the outer guide cam 14, and acts on the main butts 9c of the pile jacks 9. The annular jack cam 16 is disposed on the radially outer side of the annular leveling cam 15, has a concave cam section corresponding to the convex cam section of the annular leveling cam 15 and acts on the cam butt 9e of the pile jack 9.

A normal turning mode push-up cam 17 that acts on the rear end parts 9f of the pile jacks 9 is disposed near the concave cam section of the annular jack cam 16. A normal turning mode jack selecting device 18 is disposed between the leveling cam 15 and the jack cam 16 and near the push-up cam 17.

Figure 5A:
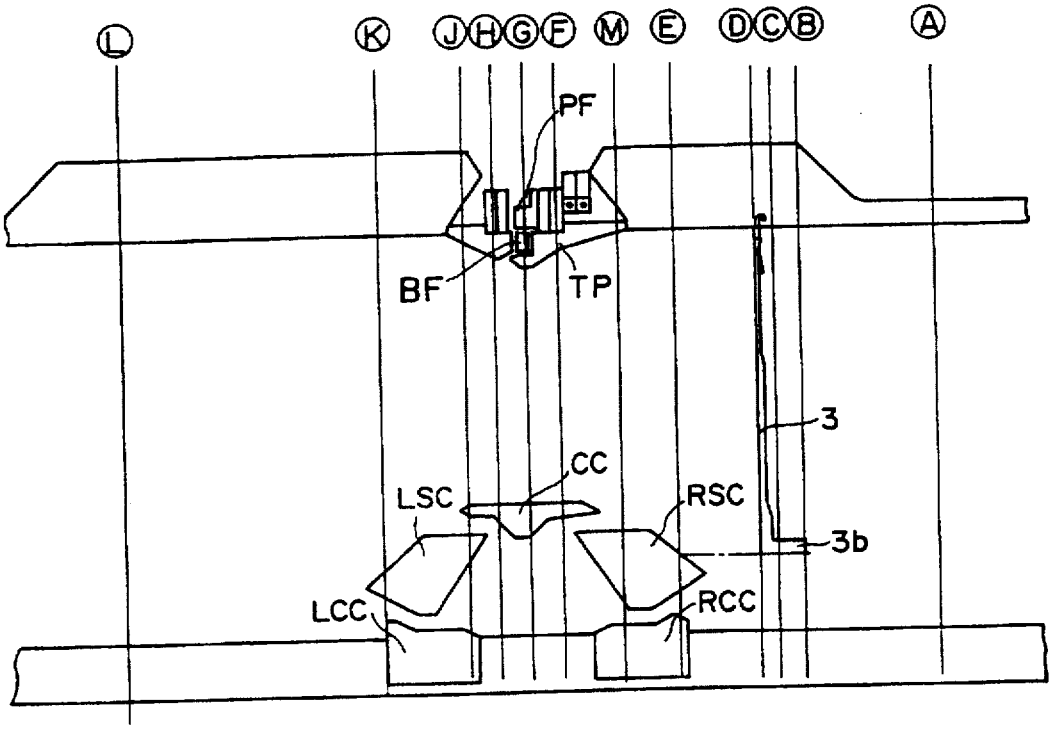
FIG. 5(*a*) is a development of a cam arrangement for controlling a pile yarn feed device and needles.
Figure 5B:
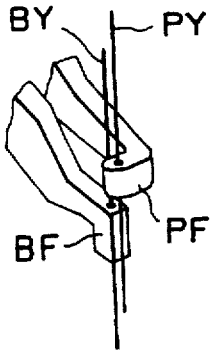

FIG. 5(*a*) is a development of a cam for controlling a pile yarn feed device and the needles 3, and FIG. 5(*b*) is a perspective view of a pile yarn guide and a ground yarn guide. In FIG. 5(*a*), lines A to L correspond to angular positions O-A to O-L indicated in FIG. 1, respectively.

In FIG. 5(*a*), a throat plate TP is disposed in the middle section of an upper cam arrangement. A pile yarn guide PF and a ground yarn guide BF are disposed alternately opposite to the throat plate TP. A center cam CC is disposed in the middle section of a lower cam arrangement. A right stitch cam RSC and a right cushion cam RCC are disposed on the right side, as viewed in FIG. 5(*a*), of the center cam CC. A left stitch cam LSC and a left cushion cam LCC are disposed on the left side, as viewed in FIG. 5(*a*), of the center cam CC. The lower cam arrangement engages with the butts 3b of the needles 3 to control the movement of the needles 3. A front end portion of the pile yarn guide PF is shown in detail in FIG. 5(*b*).

Figure 6:
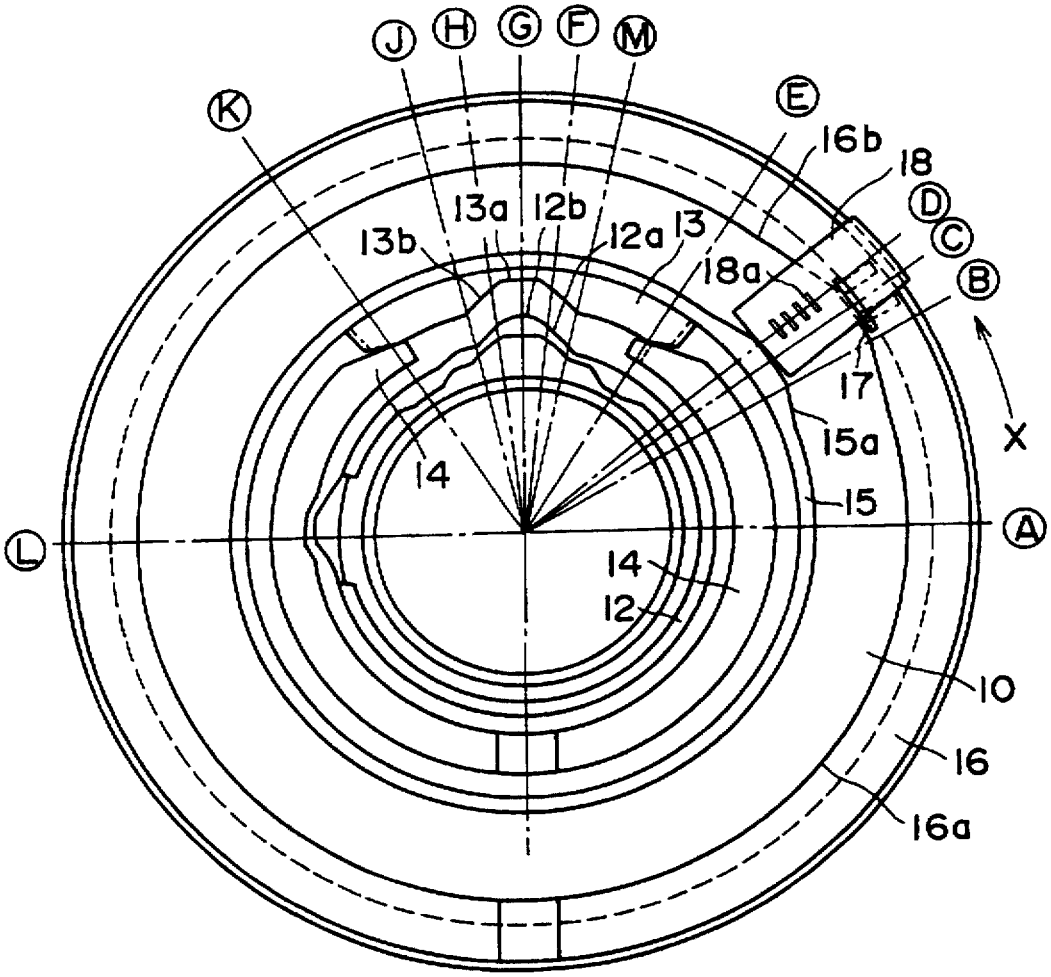
FIG. 6 is a plan view of a cam arrangement disposed on the lower surface of a sinker cap.

Cams arranged on the lower surface of the sinker cap 10 are shown in FIG. 6, in which angular positions indicated by lines O-A to O-L correspond to the angular positions indicated by lines O-A to O-L in FIG. 1, respectively.

Pile forming operations carried out by the turning of the needle cylinder 1 in the normal direction and in the reverse direction will be described with reference to sectional views taken on lines O-A to O-K of the sinker cap 10.

First, operations of each pile sinker 8 and each pile jack 9 when the needle cylinder 1 turns in the normal direction, i.e., turning in the direction of the arrow X in FIG. 6 will be described.

Figure 7:
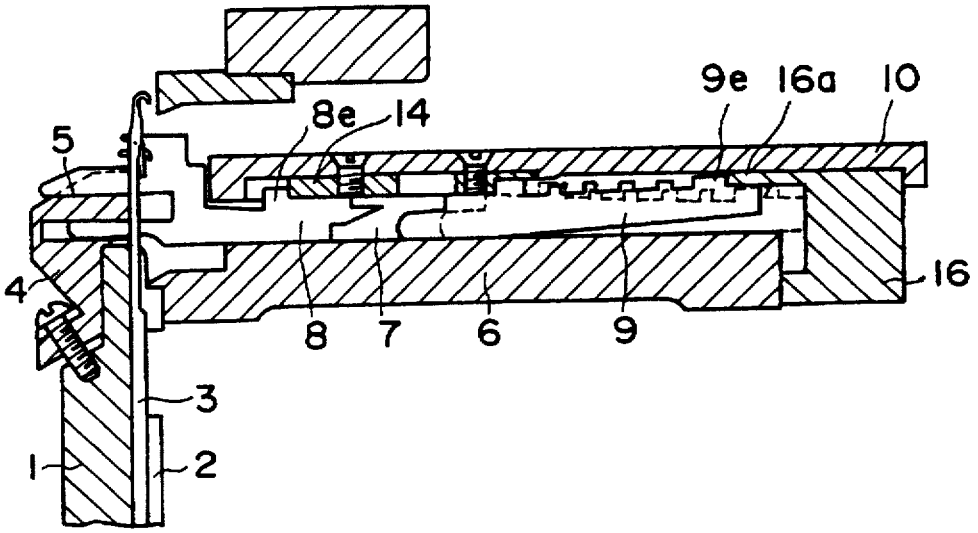
FIG. 7 is a sectional view taken on line O-A in FIG. 6.
Figure 19:
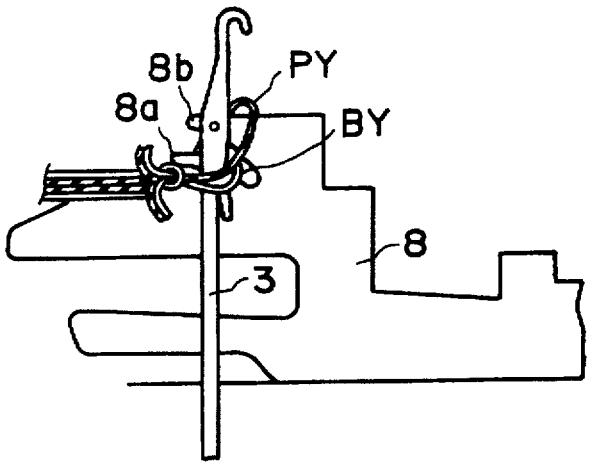
FIG. 19 is a side view of assistance in explaining actions of a needle and a pile sinker shown in FIG. 7.

In a phase shown in FIG. 7, i.e., a phase indicated by a sectional view taken on line O-A in FIG. 6, the pile jack 9 is at a position selected by the normal turning mode jack selecting device 18 in the preceding knitting cycle, i.e., either a tilting position indicated by solid lines in which the cam butt 9e is in engagement with a cam section 16a of the jack cam 16 or a nontilting position indicated by broken lines in which the cam butt 9e of the pile jack 9 is out of engagement with the cam section 16a of the jack cam 16 and positioned on the radially inner side of the cam section 16a of the jack cam 16. The butt 8e of the pile sinker 8 is in engagement with the inner surface of the outer guide cam 14. When the pile sinker 8 and the pile jack 9 are at the positions shown in FIG. 7, loops of a ground yarn BY and a pile yarn PY are held by the needle 3, and the small nib 8a and the large nib 8b of the pile sinker 8 as shown in FIG. 19.

Figure 8:
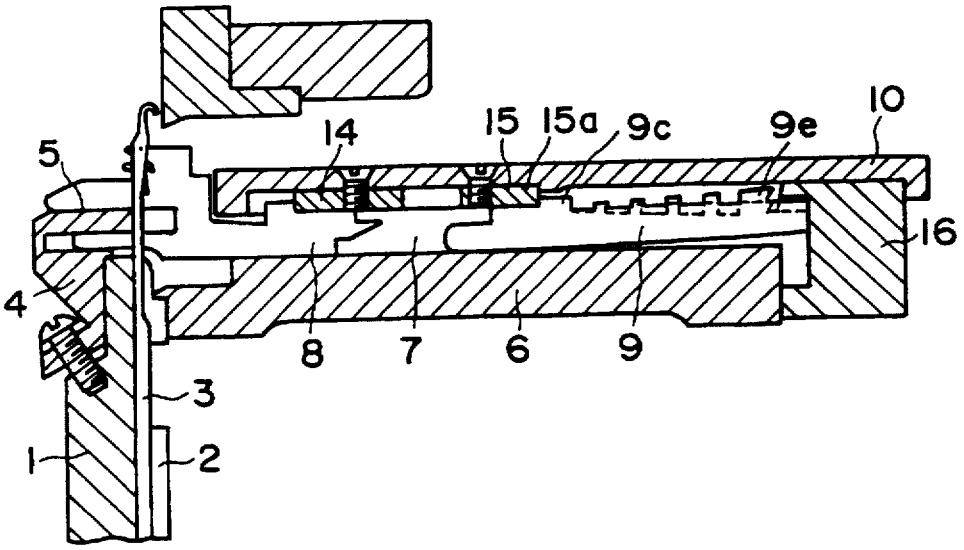
FIG. 8 is a sectional view taken on line O-B in FIG. 6.

In a phase shown in FIG. 8, i.e., a phase indicated by a sectional view taken on line O-B in FIG. 6, the convex cam section 15a of the leveling cam 15 acts on the main butt 9c of the pile jack 9 regardless of the position, i.e., the position indicated by solid lines or the position indicated by broken lines, of the pile jack 9, to push the pile jack 9 on the needle cylinder 1 radially outward, so that the cam butt 9e of the pile jack 9 is positioned in the convex cam section of the jack cam 16. In this state, the pile sinker 8 remains at the position in the phase indicated by the sectional view taken on line O-A as shown in FIG. 7.

Figure 9:
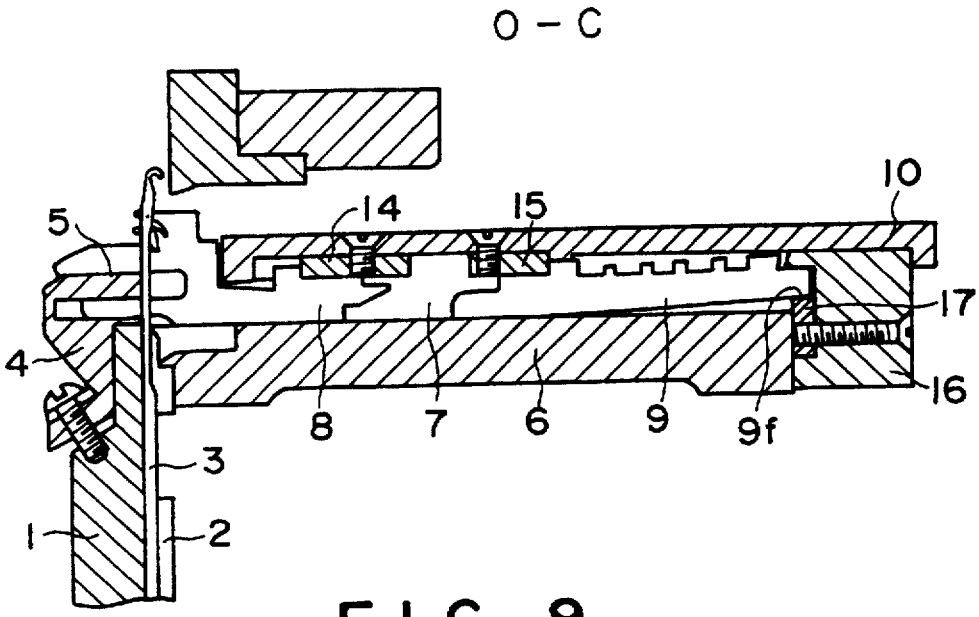
FIG. 9 is a sectional view taken on line O-C in FIG. 6.

In a phase shown in FIG. 9, i.e., a phase indicated by a sectional view taken on line O-C in FIG. 6, the the pile jack 9 at the nontilting position is pushed at its rear end part 9f by the push-up cam 17 so as to move to the tilting position. In this state, the pile sinker 8 remains at the position in the phase indicated by the sectional view taken on line O-A as shown in FIG. 7.

Figure 10:
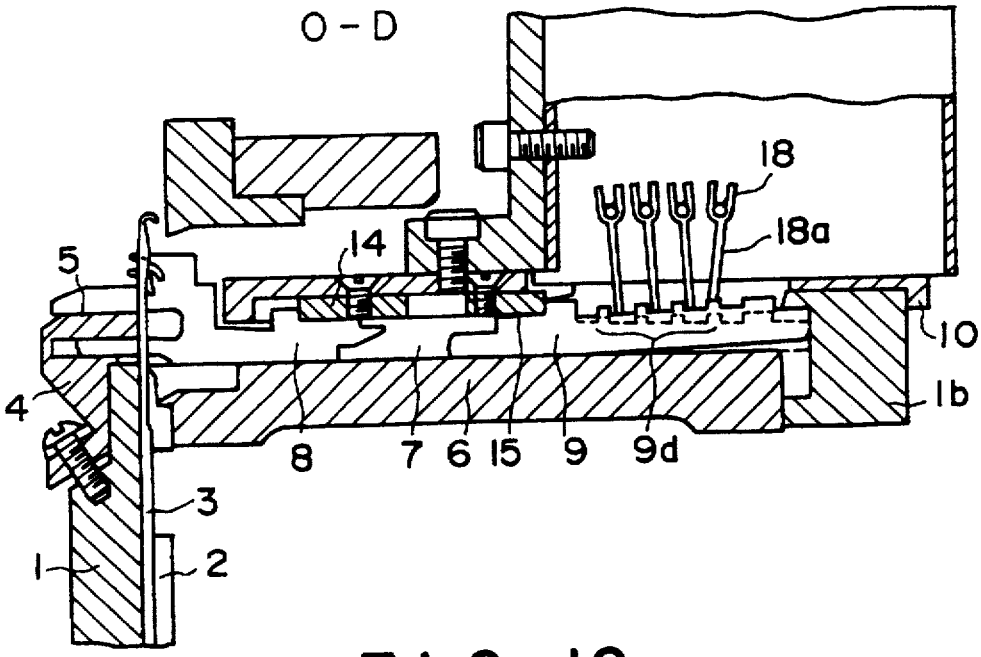
FIG. 10 is a sectional view taken on line O-D in FIG. 6.

In a phase shown in FIG. 10, i.e., a phase indicated by a sectional view taken on line O-D in FIG. 6, a plurality of actuators 18a supported for swing motion and included in the jack selecting device 18 disposed on the sinker cap 10 act selectively on the pattern butts 9d of the pile jack 9 at the tilting position according to a signal provided by a selection signal output device, not shown. When the actuators 18a act on the pattern butts 9d, the jack pile 9 is set at the nontilting position, i.e., the position indicate by broken lines. When the actuators 18a do not act on the pattern butts 9d, the pile jack 9 is set at the tilting position, i.e., the position indicated by solid lines. In this state, the pile sinker 8 remains at the position in the phase indicated by the sectional view taken on line O-A as shown in FIG. 7.

Figure 11:
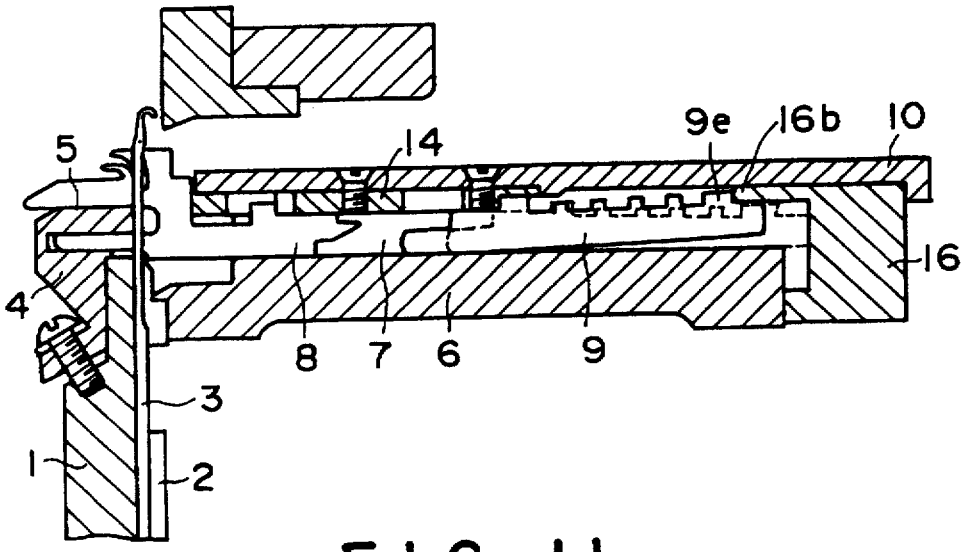
FIG. 11 is a sectional view taken on line O-E in FIG. 6.

In a phase shown in FIG. 11, i.e., a phase indicated by a sectional view taken on line O-E in FIG. 6, a radially inwardly protruding cam section 16b included in the jack cam 16 engages with the cam butt 9e of the pile jack 9 set at the tilting position indicated by solid lines in the phase shown in FIG. 10 to hold the pile jack 9 at the tilting position. The pile jack 9 set at the nontilting position in the phase shown in FIG. 10 passes the cam section 16b without being operated by the cam section 16b. In this state, the pile sinker 8 remains at the position in the phase indicated by the sectional view taken on line O-A as shown in FIG. 7.

Figure 12:
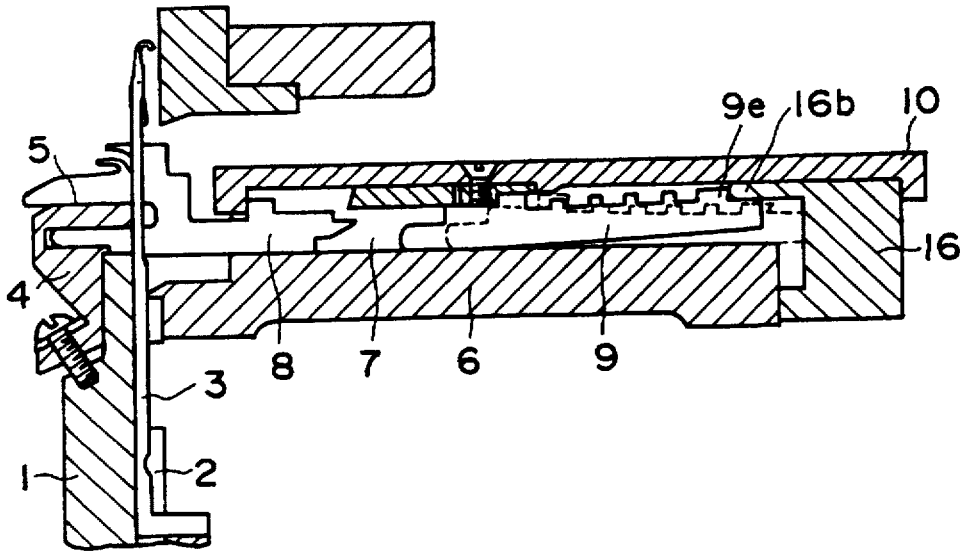
FIG. 12 is a sectional view taken on line O-M in FIG. 6.
Figure 20:
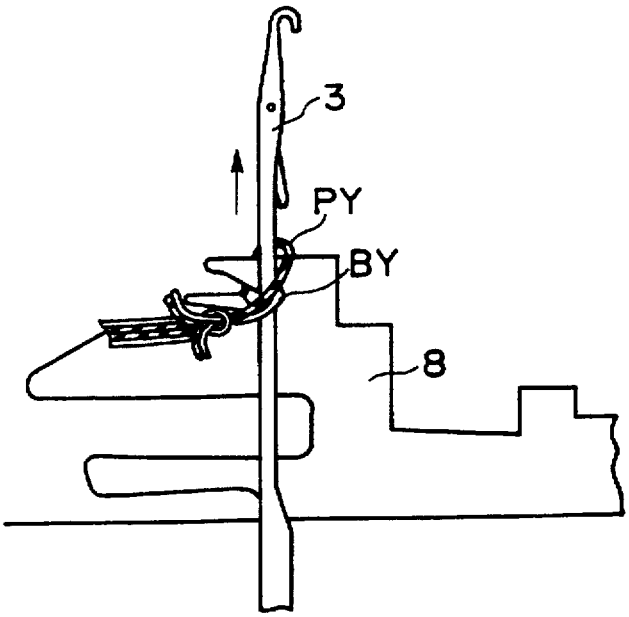
FIG. 20 is a side view of assistance in explaining actions of a needle and a pile sinker shown in FIG. 12.

In a phase shown in FIG. 12, i.e., a phase indicated by a sectional view taken on line O-M in FIG. 6, the pile sinkers 8 corresponding to the pile jacks 9 set at the tilting position, i.e., the position indicated by solid lines, and those corresponding to the pile jacks 9 set at the nontilting position, i.e., the position indicated by broken lines, in the phase shown in FIG. 11 remain at the position in the phase indicted by the sectional view taken on line O-A as shown in FIG. 7, while the needles are raised by the right stitch cam RSC (FIG. 5) to clear loops as shown in FIG. 20.

Figure 13:
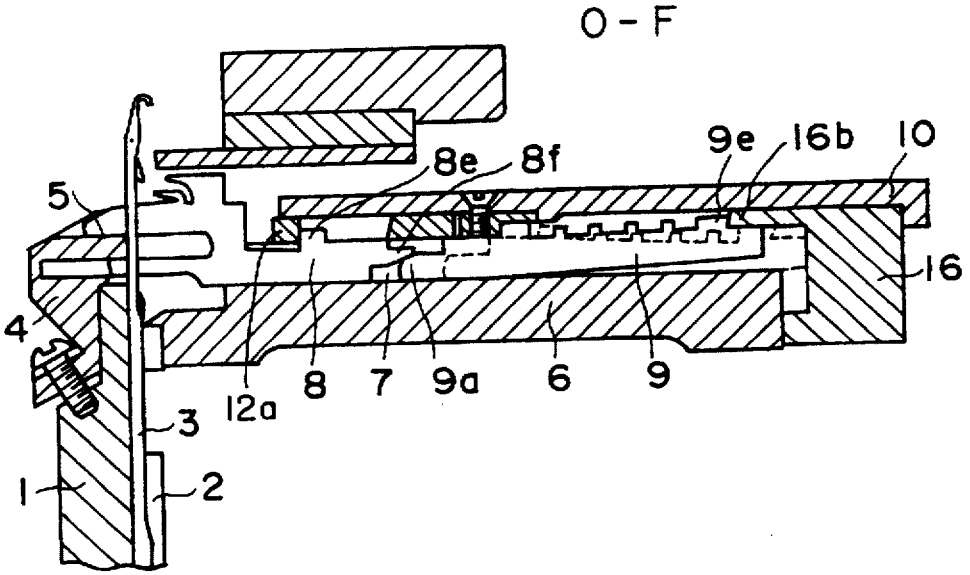
FIG. 13 is a sectional view taken on line O-F in FIG. 6.

In a phase shown in FIG. 13, i.e., a phase indicated by a sectional view taken on line O-F in FIG. 6, the butts 8e of the pile sinkers 8 corresponding to the pile jacks 9 set at the tilting position, i.e., the position indicated by solid lines, engage with the convex cam section 12a of the center cam 12 (FIG. 6) and are pushed radially outward. The tail nibs 8f of the pile sinkers thus pushed radially outward come into engagement with the thrusting noses 9a of the pile jacks 9 at the tilting position, i.e., the position indicated by solid lings. The pile sinkers 8 corresponding to the pile jacks 9 at the nontilting position, i.e., the position indicated by broken lines, remain in the foregoing state.

Figure 14:
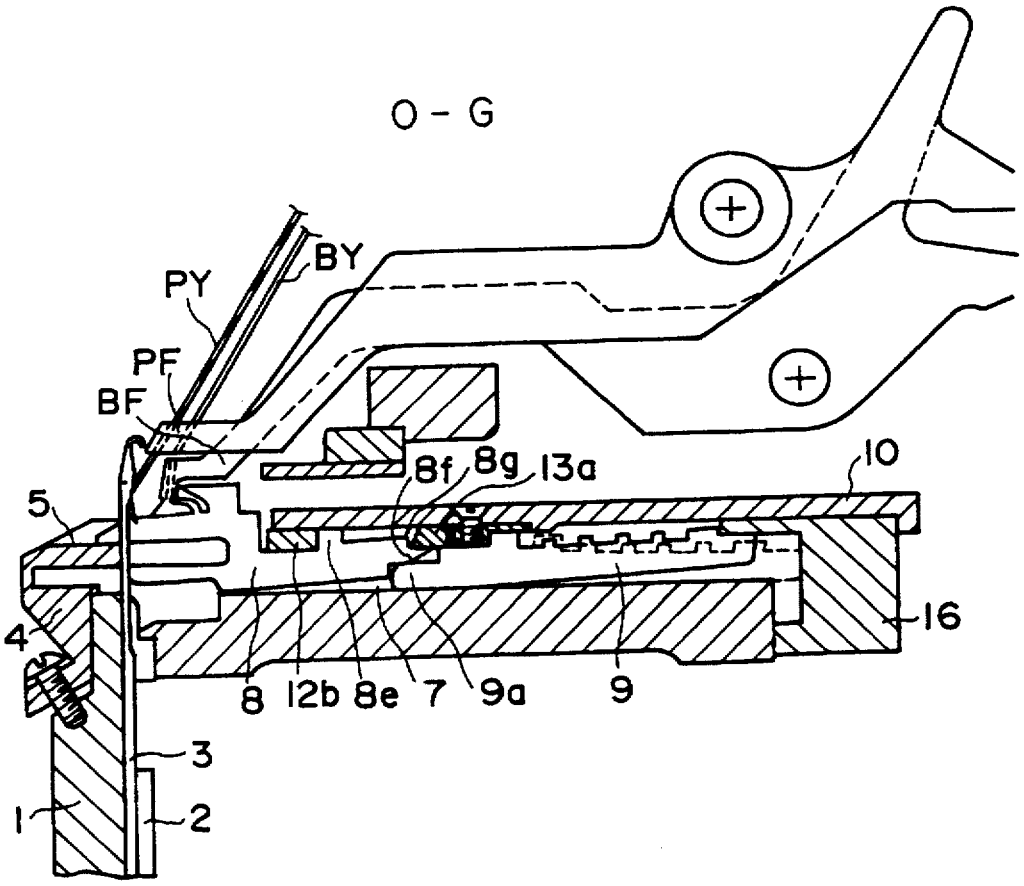
FIG. 14 is a sectional view taken on line O-G in FIG. 6.
Figure 21:
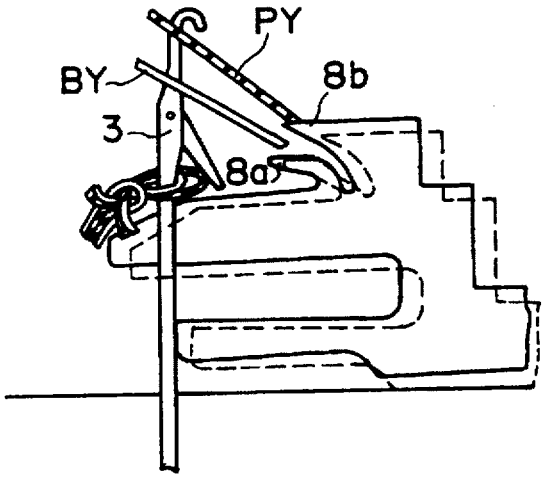
FIG. 21 is a side view of assistance in explaining actions of a needle and a pile sinker shown in FIG. 14.

In a phase shown in FIG. 14, i.e., a phase indicated by a sectional view taken on line O-G in FIG. 6, the butts 8e of the pile sinkers 8 engage with the convex cam section 12b of the center cam 12 and the pile sinkers 8 are pushed to an outermost position. The thrusting noses 9a of the pile jacks 9 engage with the tail nibs 8f of the pile sinkers 8 corresponding to the pile jacks 9 at the tilting position among the pile sinkers 8 to cause those sinkers to be tilted. A convex cam section 13a of the center counter cam 13 engages with the cam following parts 8g of the tilted pile sinkers 8. The convex cam section 13a of the center counter cam 13 does not engage with the cam following parts 8g of the pile sinkers 8 corresponding to the pile jacks 9 at the nontilting position and hence those pile sinkers 8 remains in a horizontal position. At a position corresponding to line G in the development of the cam arrangement shown in FIG. 5(*a*), a pile yarn PY is fed through the pile yarn guide PF onto the large nib 8b of the pile sinker 8, and a ground yarn BY is fed through the ground yarn guide BF onto the small nib 8a of the pile sinker 8, as indicated in FIG. 21.

Figure 15:
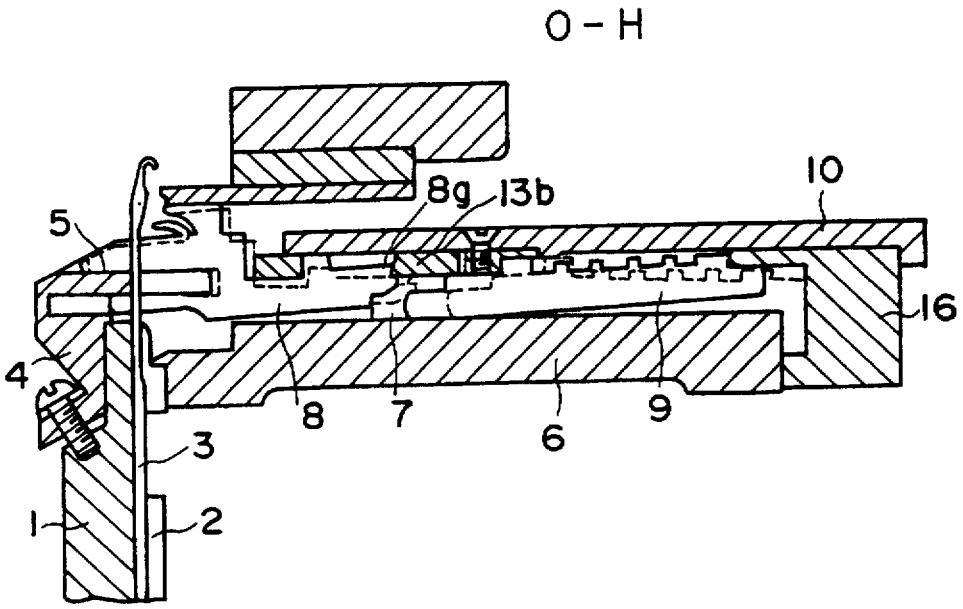
FIG. 15 is a sectional view taken on line O-H in FIG. 6.

In a phase shown in FIG. 15, i.e., a phase indicated by a sectional view taken on line O-H in FIG. 6, a cam section 13b of the center counter cam 13 engages with the cam following part 8g of the tilted pile sinker 8 in engagement with the pile jack 9 set at the tilting position in the phase shown in FIG. 14 to advance the pile sinker 8 radially inward.

Figure 16:
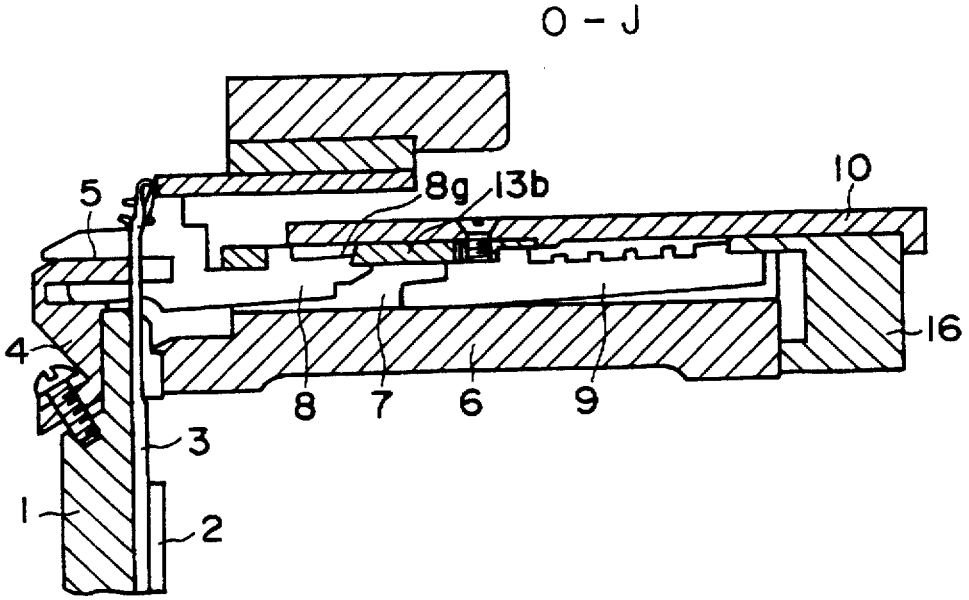
FIG. 16 is a sectional view taken on line O-J in FIG. 6, showing a pile jack in a tilted state.
Figure 22:
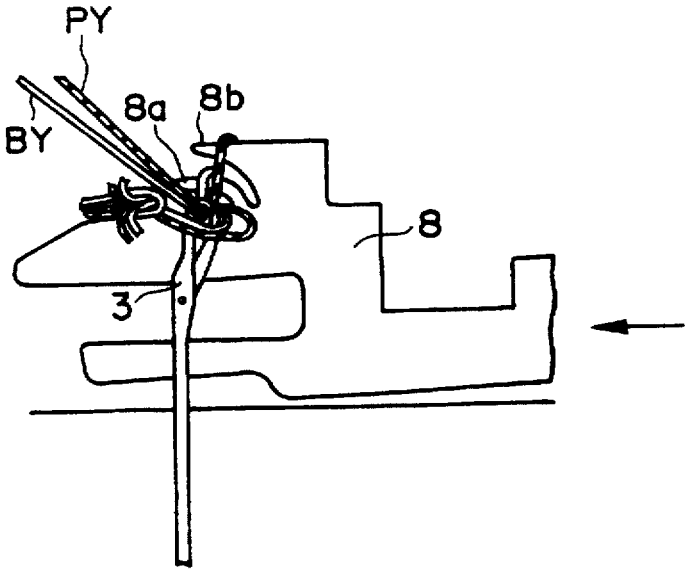
FIG. 22 is a side view of assistance in explaining actions of a needle and a pile sinker shown in FIG. 16.

In a phase shown in FIG. 16, i.e., a phase indicated by a sectional view taken on line O-J in FIG. 6, the center counter cam 13 advances the pile sinker 8 which has been in engagement with the pile jack 9 at the tilting position further radially inward by the center counter cam 13 so that the small nib 8a and the large nib 8b of the pile sinker 8 extend between adjacent needles 3 as shown in FIG. 22. Consequently, the pile yarn PY fed through the pile yarn guide PF laps around the large nib 8b, and the ground yarn BY fed through the ground yarn guide BF laps around the small nib 8a to form a pile loop and a ground loop.

Figure 17:
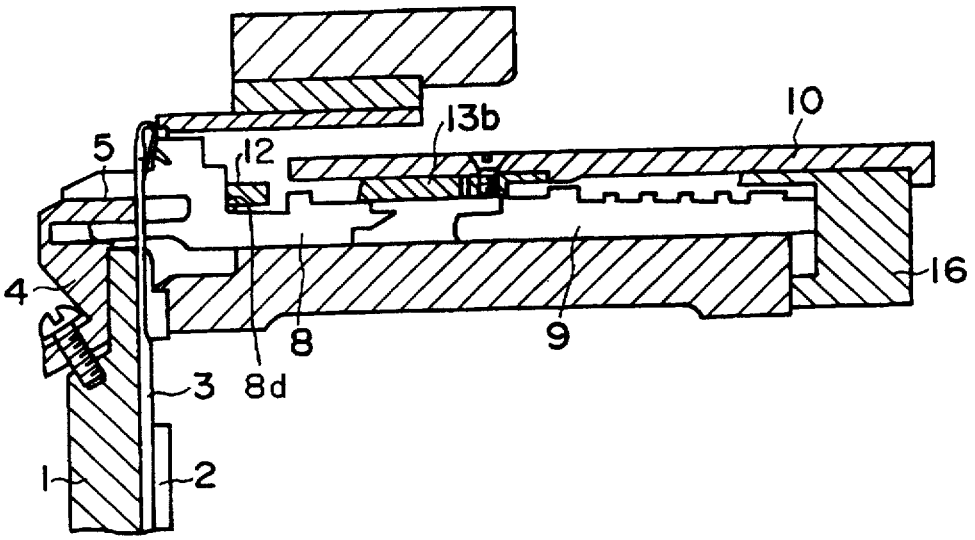
FIG. 17 is a sectional view taken on line O-J in FIG. 6, showing a pile jack in a horizontal state.
Figure 23:
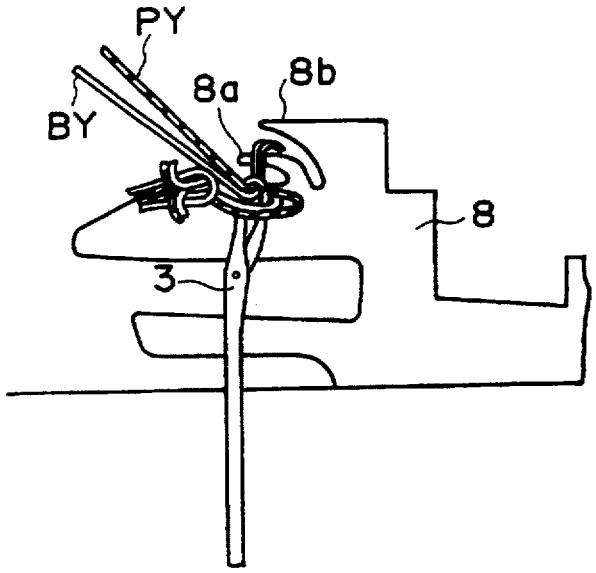
FIG. 23 is a side view of assistance in explaining actions of a needle and a pile sinker shown in FIG. 17.

As shown in FIG. 17, the center counter cam 13 does not act on the pile sinker 8 in a horizontal position. However, an inner cam section of the center cam 12 engages with the back edge 8d to advance the pile sinker 8 radially inward so that the small nib 8a of the pile sinker 8 extends between the adjacent needles 3 as shown in FIG. 23. Consequently, both the pile yarn PY and the ground yarn BY lap around the small nib 8a to form a plain stitch.

Figure 18:
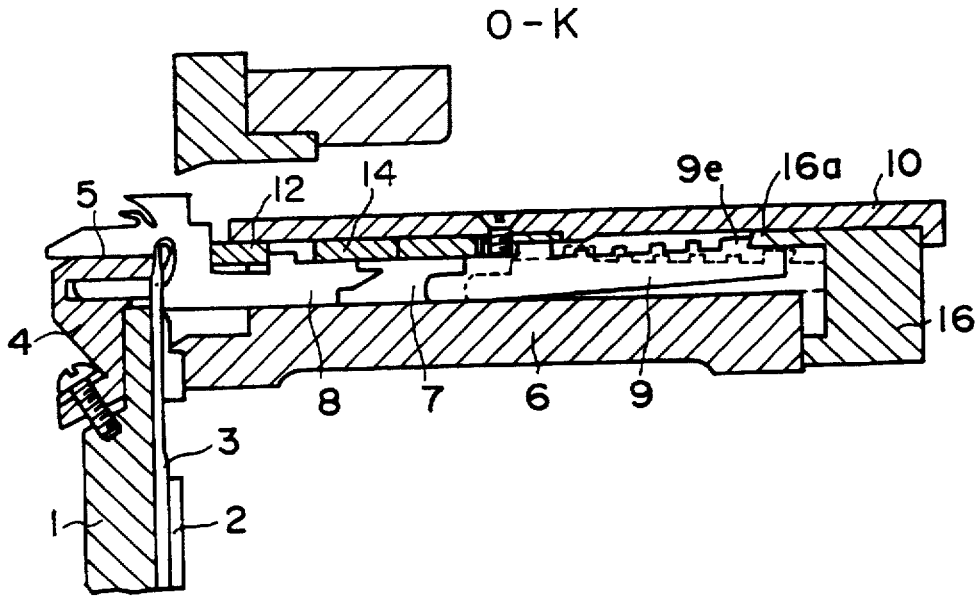
FIG. 18 is a sectional view taken on line O-K in FIG. 6.

In a phase shown in FIG. 18, i.e., a phase indicated by a sectional view taken on line O-K in FIG. 6, the pile sinker 8 in the tilted position shown in FIG. 16 is set in a horizontal state by the outer guide cam 14.

Figure 24:
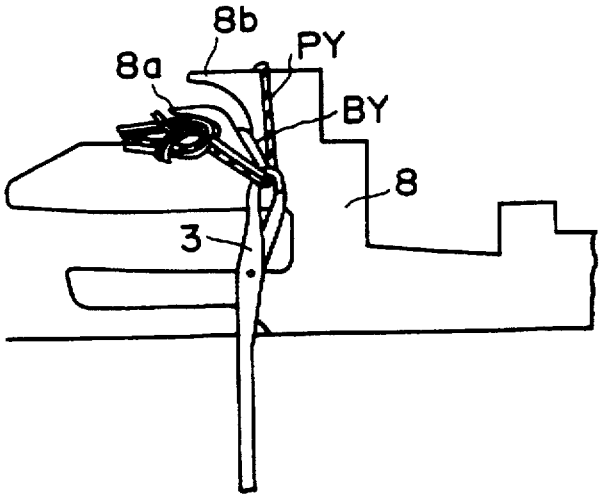
FIG. 24 is a side view of assistance in explaining actions of a needle and a pile sinker shown in FIG. 18.

All the pile sinkers 8 are further advanced from the position in the phase indicated by the sectional view taken on line O-J by an inner cam section of the center cam 12 regardless of their positions, i.e., either the tilted position or the nontilted position, to receive the ground yarn BY in the throat under the small nib 8a as shown in FIG. 24. The length of the base loop of the base yarn BY formed by the descending needle 3 in this state is a basic loop length, and the length of the pile loop of the pile yarn PY formed by the descending needle 3 in this state is a pile loop length.

Although actions available by the turning of the needle cylinder 1 in the normal direction have been described, it is to be noted that the reverse turning of the needle cylinder 1 is to be started with the cam butt 9e of the pile jack 9 selected by the actuators 18a of the jack selecting device 18 kept in engagement with the cam section 16b of the jack cam 16 when the pile sinker 8 is to perform the same actions as those carried out during the normal turning of the needle cylinder 1 during the reverse turning of the needle cylinder 1 subsequent to the normal turning of the same. Consequently, the jack sinkers 8 corresponding to the same pile jacks 9 selected during the normal turning of the needle cylinder 1 carries out the same actions as those carried out during the normal turning of the needle cylinder 1 to form pile loops the same as those formed during the normal turning of the needle cylinder 1, when the needle cylinder 1 turns in the reverse direction. However, such actions are carried out when the needle cylinder 1 turns in the reverse direction only by the sinkers 8 corresponding to the pile jacks 9 in the range between positions corresponding to lines G to A, which are kept in a selected state.

Figure 25:
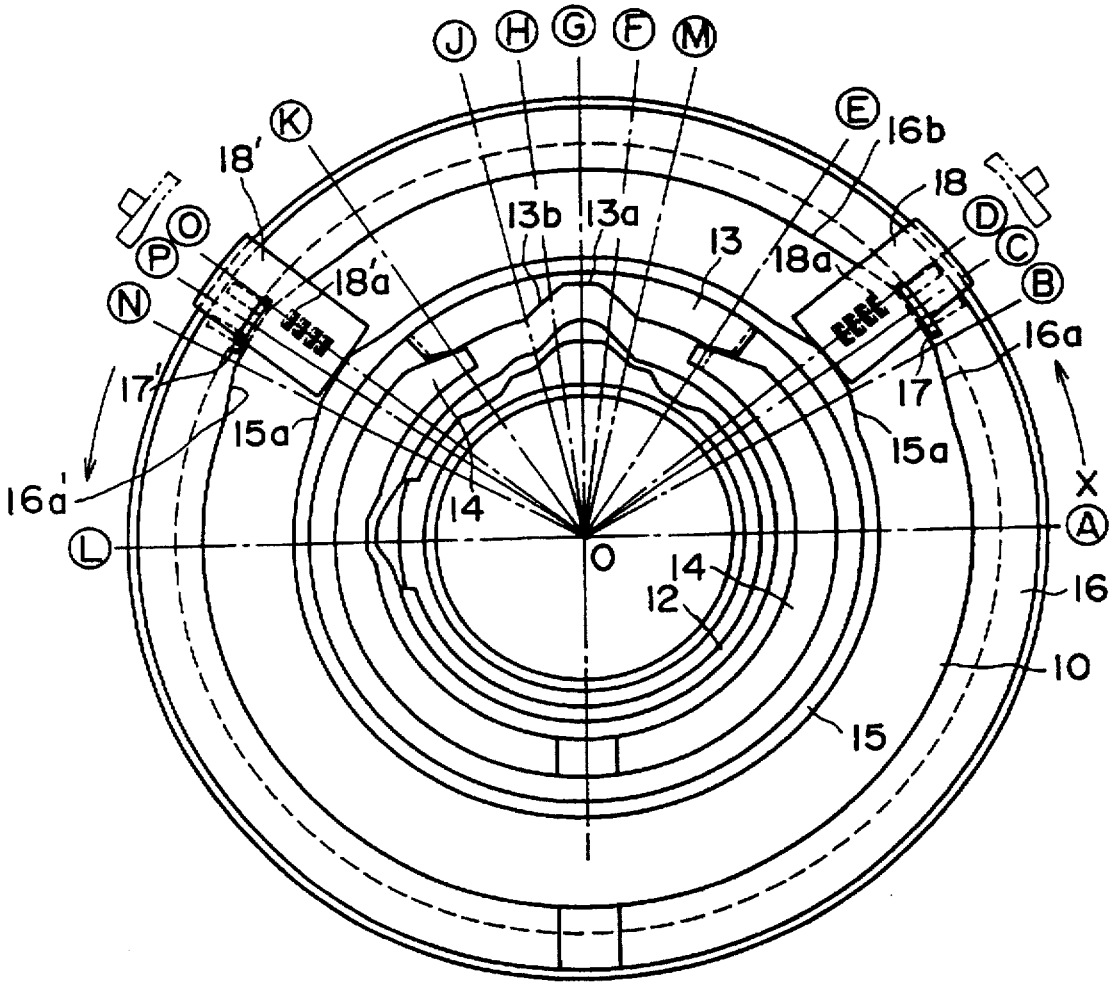
FIG. 25 is a plan view of a cam arrangement included in a pile patterning mechanism in a second embodiment according to the present invention in a state for a normal turning mode in which a needle cylinder is turned in the normal direction.
Figure 26:
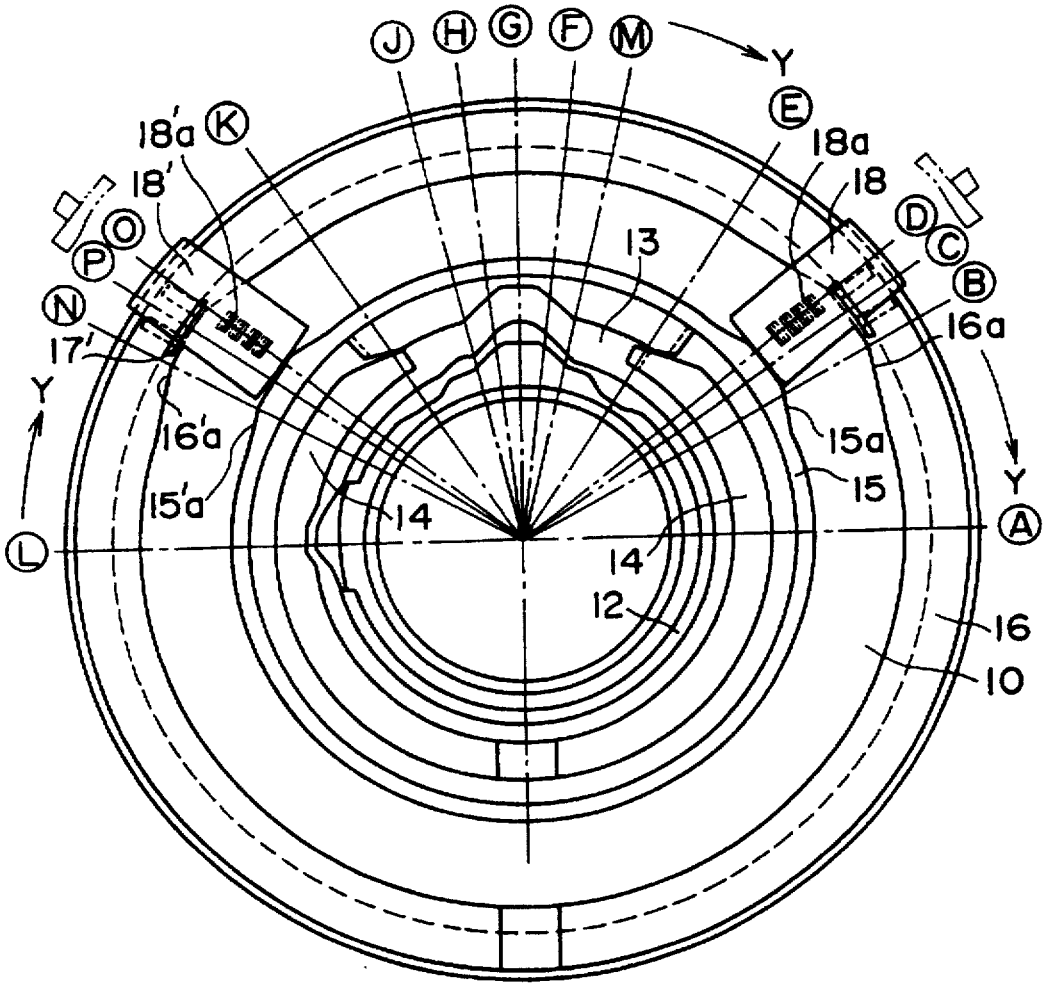
FIG. 26 is a plan view of the cam arrangement shown in FIG. 25 in a state for a reverse turning mode in which the needle cylinder is turned in the reverse direction.

FIG. 25 is a plan view of a cam arrangement included in a pile patterning mechanism in a second embodiment according to the present invention in a state for a normal turning mode in which a needle cylinder is turned in the normal direction, and FIG. 26 is a plan view of the cam arrangement shown in FIG. 25 in a state for a reverse turning mode in which the needle cylinder is turned in the reverse direction. The cam arrangement shown in FIG. 25 is provided in its left half portion as viewed in FIG. 25 in addition to components corresponding to those of the cam arrangement shown in FIG. 6, with a convex cam section 15a' on a leveling cam 15, and a concave cam section 16a', a reverse turning mode push-up cam 17' and a reverse turning mode jack selecting device 18' on a reverse on a jack cam 16. As shown in FIGS. 25 and 26, the the convex cam sections 15a and 15a' of the leveling cam 15, the normal turning mode concave cam Section 16a and the reverse turning mode concave cam section 16a' of the jack cam 16, the normal turning mode push-up cam 17 and the reverse turning mode push-up cam 17', the jack selecting devices 18 and 18' are disposed symmetrically with respect to line O-G so that the pile sinkers 8 and the pile jacks 9 are operated in the reverse turning mode, in which the cylinder 1 is turned in the reverse direction indicated by the arrow Y in FIG. 26, by the same actions as those employed in operating the pile sinkers 8 and the pile jacks 9 in the normal turning mode, in which the needle cylinder 1 is turned in the normal direction indicated by the arrow X in FIG. 25.

Accordingly, the cam arrangement shown in FIGS. 25 and 26 is able to select the pile jacks 9 other than those selected by the jack selecting device 18 for the normal turning mode, by the jack selecting device 18' for the reverse turning mode to control the pile sinkers 8 selectively, so that piles can be formed on optional wales and optional courses.

Figure 27:
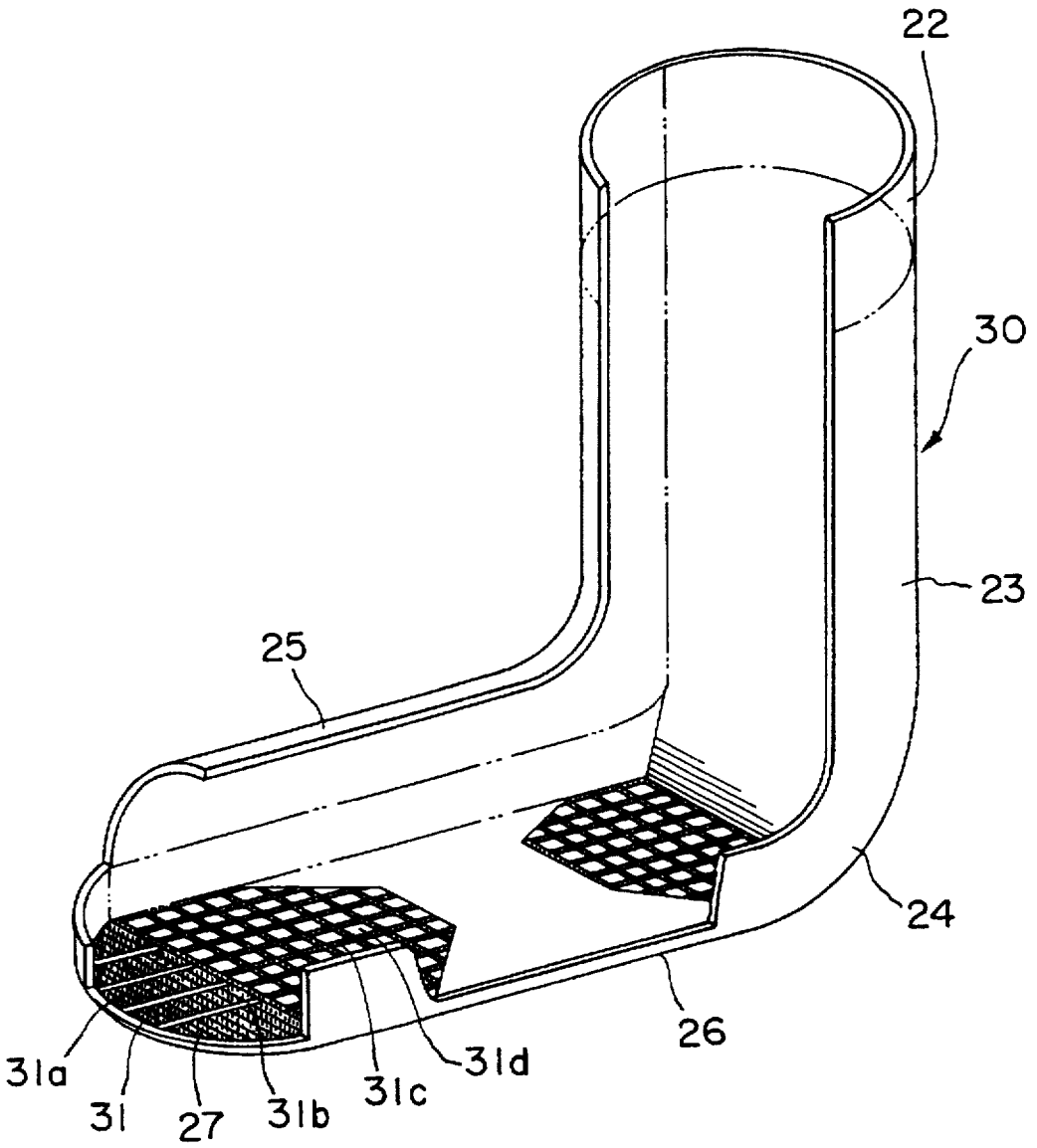
FIG. 27 is partly cut-away, typical perspective view of a pair of stocks having a pile stitch portion, in accordance with the present invention.

FIG. 27 is a partly cutaway view of a sock 30, i.e., a pile stitch article, having pile stitch portions in accordance with the present invention. The sock 30 is knitted by a 24 G circular knitting machine having a 4 in. needle cylinder provided with 132 needles by stitching a 40/70 FTY as a ground yarn and a 32's acrylic-cotton blended yarn as a pile yarn. The sock 30 has a rib top section 22, a body section 23, a heel section 24, an insole section 25, a sole section 26 and a toe section 27.

Figure 28:
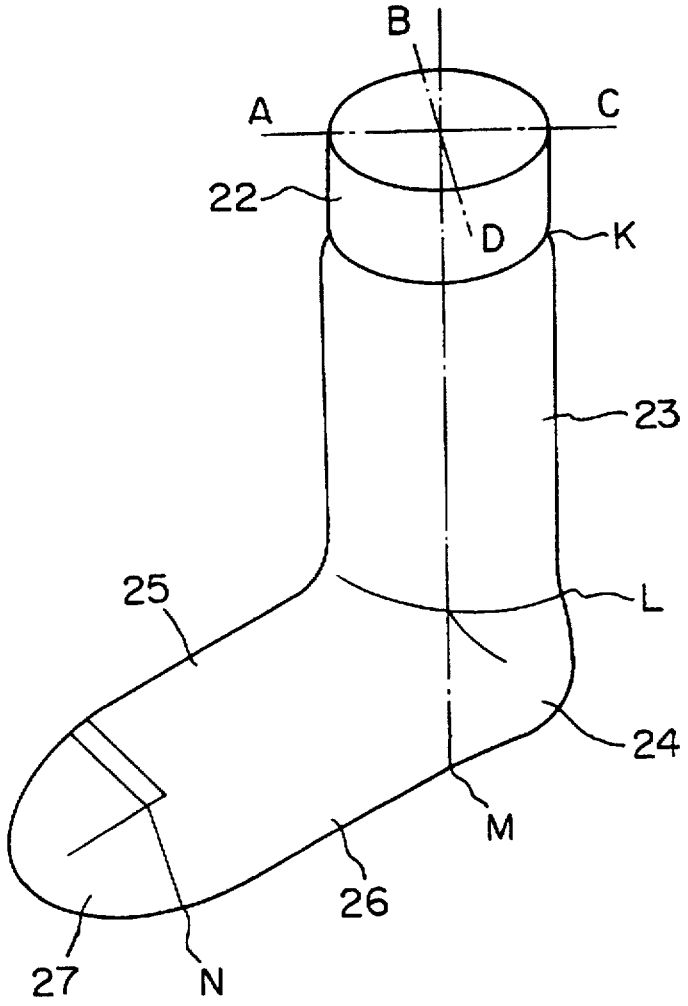
FIG. 28 is a perspective view of the sock of FIG. 27.
Figure 29:
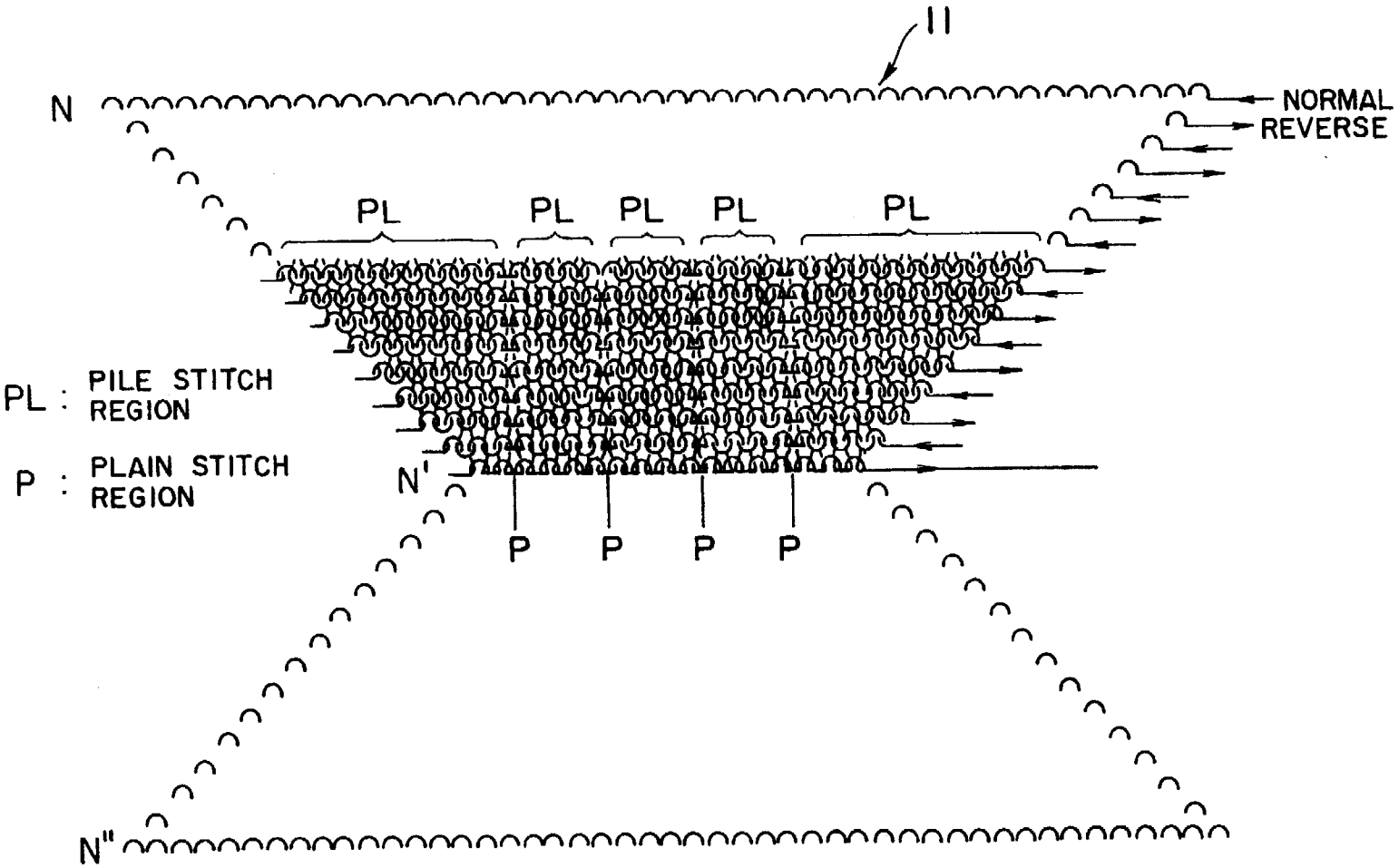
FIG. 29 is diagrammatic view showing a knit structure of a pile stitch portion.
Figure 30:
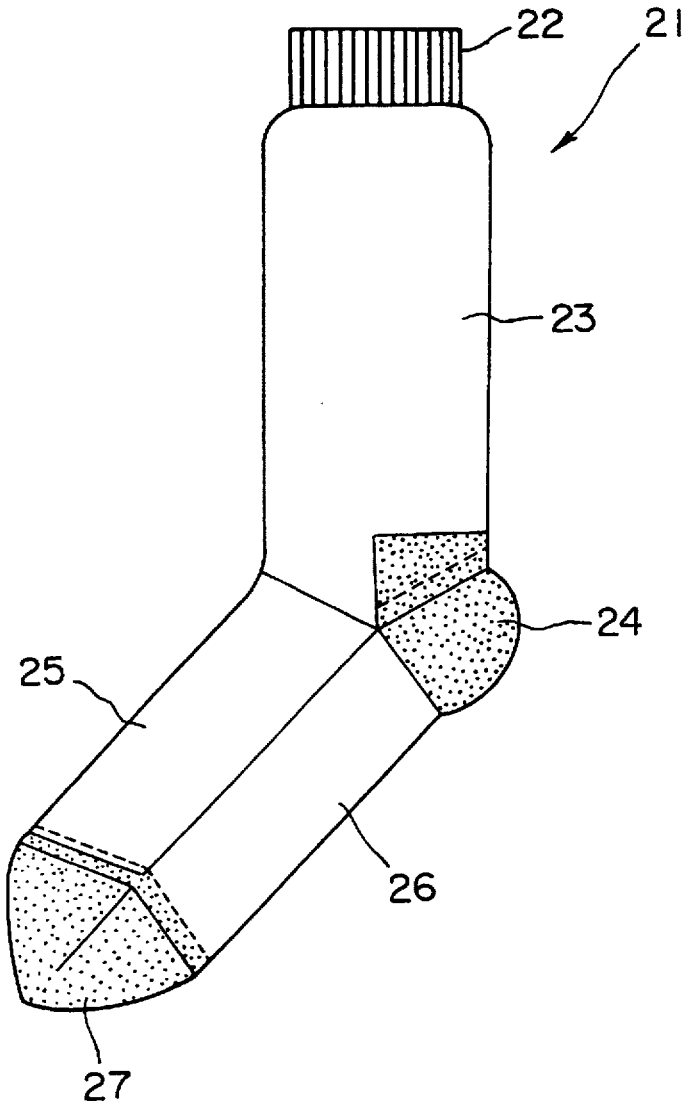
FIG. 30 is a side view of one of a pair of conventional socks.

Referring to FIGS. 28 and 29, the needle cylinder is turned in the normal direction, i.e., a direction from a point A via points B and C toward a point D, to knit the rib top section 22, a stitch changing part K and the body section 23. The needle cylinder is turned alternately in the normal direction and in the reverse direction in an angular range from the point B via the point C to the point D to knit a stitch changing part L between the body section 23 and the heel section 24, and the heel section 24. The needle cylinder is turned in the normal direction to knit a stitch changing part M between the heel section 24 and the insole section 26, the insole section 25 and the sole section 26. The needle cylinder is turned alternately in the normal direction and in the reverse direction to knit a stitch changing part N and the toe section 27 (N, N', N").

As shown in FIG. 27, a pile stitch portion 31 formed on the inner surface of the toe section 27 has wide pile stitch regions 31*a* and narrow plain stitch regions 31*b*. The width of the narrow plain stitch regions 31*b* may optionally be determined. Pile loops are formed on desired wales in the pile stitch portion 31 in the toe section 27 by the needles that are moved vertically as the needle cylinder is turned alternately in the normal direction and in the reverse direction regardless of the needle loops forming operations of the needles.

FIG. 29 shows the stitch structure of the pile stitch portion 31 in the toe section 27. In this pile stitch portion 31, the number of wales is decreased gradually from the stitch changing part N toward the stitch changing part N', and then the number of wales is increased gradually from the stitch changing part N' toward a stitch changing part N". When knitting the pile stitch portion 31 by alternately carrying out a first stitching stage, in which the needle cylinder is turned in the normal direction, and a second stitching stage, in which the needle cylinder is turned in the reverse direction, optional wales are formed in the pile stitch portion 31 by turning the needle cylinder alternately in the normal direction and in the reverse direction regardless of the operations of the needles to form needle loops in the pile stitch portion 31. Piles are formed on optional wales while the needle cylinder turns in the normal direction and piles are formed while the cylinder is turned in the reverse direction on optional wales other than those on which the piles are formed while the needle cylinder is turned in the normal direction. This stitching operation in such a mode is carried out continuously for a region between the stitch changing parts N and N". Thus, the pile stitch portion 31 consists of successive pile stitch courses, and has the wide pile stitch regions 31*a* (PL) and the narrow plain stitch regions 31*b* (P).

As shown in FIG. 27, the sole section 26 has meshed pile stitch regions 31*c* and plain stitch regions 31*d* filling up spaces demarcated by the pile stitch regions 31*c*. The meshed pile stitch regions 31*c* can be formed on optional wales. The sole section 26 having a high air permeability and a fine texture can be formed by forming pile stitches of different sizes when the needle cylinder is turned in the normal direction and in the reverse direction, respectively. Since the sole section 26 has the spaces demarcated by the meshed pile stitch regions 31*c* filled up with the plain stitch regions 31*d*, the sole section 26 has, in addition to satisfactory air permeability and cushioning effect, favor-able effects of human engineering, such as effects of finger-pressure therapy, serviceable to maintaining health.

Although the present invention has been described as applied to a sock provided with a pile stitch portion in its toe section, the present invention is applicable to knitted textile articles including stockings, tights, panty hose and the like having pile stitch portions in their toe sections, heel sections and/or knee sections.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. A pile patterning mechanism for a circular knitting machine, comprising:

a sinker bed provided with a plurality of radial, horizontal grooves and disposed on an outer circumference of an upper end of a needle cylinder;

a plurality of pile sinkers fitted in the radial, horizontal grooves of the sinker bed, respectively, so as to be slidable along, and tiltable in the grooves;

a plurality of pile jacks each having a plurality of butts and fitted in the radial, horizontal grooves of the sinker bed on a radially outer side of the pile sinkers so as to be slidable along, and tiltable in the grooves;

a pile sinker control means for controlling sliding and tilting movements of the pile sinkers and a pile jack control means for controlling sliding and tilting movements of the pile jacks, said pile jack control means including a jack cam and a jack selecting device provided with actuators.

2. The pile patterning mechanism according to claim 1, wherein each of said pile jacks has a horizontally elongated shape.

3. The pile patterning mechanism according to claim 2, wherein each of the pile jacks has at a radially inner end thereof a thrusting nose for acting on a radially outermost end of each of the pile sinkers.

4. The pile patterning mechanism according to claim 3, wherein each of the pile jacks has at a radially inner end thereof a pivotal part about which the pile jack is tiltable.

5. The pile patterning mechanism according to claim 3, wherein each of the pile jacks has a main butt projecting upward at a position radially outward of the thrusting nose and a cam butt projecting upward at a position radially outward of the main butt.

6. The pile patterning mechanism according to claim 5, wherein each of the pile jacks has pattern butts projecting upward at positions between said main butt and said cam butt, said pattern butts being positioned to be acted upon by said jack selecting device.

7. The pile patterning mechanism according to claim 5, wherein a leveling cam is provided for acting on said main butt.

8. The pile patterning mechanism according to claim 5, wherein said cam means for acting on the pile jacks include an annular jack cam acting on said cam butt.

9. The pile patterning mechanism according to claim 8, wherein said jack cam has a cam section for shifting the pile jacks radially inward.

10. The pile patterning mechanism according to claim 5, wherein said cam means for acting on the pile jacks include a push-up cam acting on a radially outer end part of each pile jack to push up the end part for tilting movement of the pile jacks.

11. A pile patterning mechanism for a circular knitting machine, comprising:

a sinker bed provided with a plurality of radial, horizontal grooves and disposed on an outer circumference of an upper end of the needle cylinder;

a plurality of pile sinkers fitted in the radial, horizontal grooves of the sinker bed, respectively, so as to be slidable along, and tiltable in the grooves;

a plurality of pile jacks each having a plurality of butts and fitted in the radial, horizontal grooves of the sinker bed on a radially outer side of the pile sinkers so as to be slidable along, and tiltable in the grooves;

a pile sinker control means for controlling sliding movement of the pile sinkers; and a pile jack control means for controlling sliding and tilting movements of the pile jacks, said pile jack control means including a jack cam and a jack selecting device provided with actuators.

12. The pile patterning mechanism according to claim 11, wherein each of said pile jacks has a horizontally elongated shape.

13. The pile patterning mechanism according to claim 12, wherein each of the pile jacks has at a radially inner end thereof a thrusting nose for acting on a radially outermost end of each of the pile sinkers.

14. The pile patterning mechanism according to claim 13, wherein each of the pile jacks has at a radially inner end thereof a pivotal part about which the pile jack is tiltable.

15. The pile patterning mechanism according to claim 13, wherein each of the pile jacks has a main butt projecting upward at a position radially outward of the thrusting nose and a cam butt projecting upward at a position radially outward of the main butt.

16. A pile patterning mechanism for a circular knitting machine, comprising:

a sinker bed provided with a plurality of radial horizontal grooves and disposed on an outer circumference of an upper end of the needle cylinder;

a plurality of pile sinkers fitted in the radial, horizontal grooves of the sinker bed, respectively, so as to be slidable along, and tiltable in the grooves;

a plurality of pile jacks each having a plurality of butts and fitted in the radial, horizontal grooves of the sinker bed on a radially outer side of the pile sinkers so as to be slidable along, and tiltable in the grooves;

a pile sinker control means for controlling tilting movement of the pile sinkers; and a pile jack control means for controlling sliding and tilting movements of the pile jacks, said pile jack control means including a jack cam and a jack selecting device provided with actuators.

17. The pile patterning mechanism according to claim 16, wherein each of said pile jacks has a horizontally elongated shape.

18. The pile patterning mechanism according to claim 17, wherein each of the pile jacks has at a radially inner end thereof a thrusting nose for acting on a radially outermost end of each of the pile sinkers.

19. The pile patterning mechanism according to claim 18, wherein each of the pile jacks has at a radially inner end thereof a pivotal part about which the pile jack is tiltable.

20. The pile patterning mechanism according to claim 18, wherein each of the pile jacks has a main butt projecting upward at a position radially outward of the thrusting nose and a cam butt projecting upward at a position radially outward of the main butt.

* * * * *

UNITED STATES PATENT AND TRADEMARK OFFICE

CERTIFICATE OF CORRECTION

PATENT NO. : 5,713,220

DATED : February 3, 1998

INVENTOR(S) : Masahiro Seino, et al.

It is certified that error appears in the above-identified patent and that said Letters Patent is hereby corrected as shown below:

Title page, left column, item [75], Please delete the names of the third and fourth Inventors (Satoshi Okashi and Shinya Yamamoto)

Signed and Sealed this

Twenty-eighth Day of December, 1999

*Attest:*

Q. TODD DICKINSON

*Attesting Officer*

*Acting Commissioner of Patents and Trademarks*